United States Patent [19]

Stone

[11] 4,210,953

[45] Jul. 1, 1980

[54] SELF-ILLUMINATED CASE

[76] Inventor: Wilfred S. Stone, Box 4, Wayne, Ill. 60184

[21] Appl. No.: 743,414

[22] Filed: Nov. 19, 1976

Related U.S. Application Data

[60] Continuation of Ser. No. 557,277, Mar. 10, 1975, which is a continuation of Ser. No. 424,321, Dec. 13, 1973, which is a division of Ser. No. 299,858, Oct. 24, 1972, Pat. No. 3,796,869.

[51] Int. Cl.[2] ..... F21L 7/00; F21V 23/04

[52] U.S. Cl. ..... 362/189; 362/205; 362/394

[58] Field of Search ..... 240/10.6, 10.65, 10.66, 240/10.67; 46/45; 200/60; 362/394

[56] References Cited

U.S. PATENT DOCUMENTS

| | | | |
|---|---|---|---|
| 3,256,428 | 6/1966 | Schwartz | 240/10.65 |
| 3,443,084 | 5/1969 | Jammet | 240/10.65 |
| 3,564,761 | 2/1971 | Bear | 200/60 |
| 3,758,773 | 9/1973 | Nau | 240/10.6 R |
| 3,796,869 | 3/1974 | Stone | 362/189 |
| 4,032,773 | 6/1977 | Halliday, Jr. et al. | 240/10.6 |

FOREIGN PATENT DOCUMENTS 1443787 5/1966 France .

*Primary Examiner*—Stephen C. Bentley
*Assistant Examiner*—Edward F. Miles
*Attorney, Agent, or Firm*—August E. Roehrig, Jr.

[57] ABSTRACT

This invention relates to a flashlight (1) that may be seen in the dark, (2) which carries a universal mounting on one external wall, and (3) an internal switch adjacent the opposite wall which is elastic and which on pressing will close the switch. By mounting the flashlight above, for example, a keyhole, the flashlight can be seen, and when the outer wall is pressed, the keyhole is illuminated. Moreover, the light bulb within three or four seconds restores the phosphorescent band to luminosity, (reactivation chamber) because part of it is located in a regenerative phosphorescent chamber so that it performs not only the normal lighting function, but regenerates the phosphorescent material on the chamber walls as well. The phosphorescent material, a zinc sulphide or zinc-cadmium sulphide (harmless) has a persistence of glow of two to twelve hours.

5 Claims, 9 Drawing Figures

MAINE BANK
MEMBER OF F.D.I.C.

SELF-ILLUMINATED CASE

This is a continuation of application Ser. No. 557,277, filed Mar. 10, 1975, which is in turn a continuation of application Ser. No. 424,321, filed Dec. 13, 1973, which is itself a divisional of Ser. No. 299,858, filed Oct. 24, 1972 (now U.S. Pat. No. 3,796,869).

THE INVENTION AND ITS BACKGROUND

Small purse lights are very old. Their greatest defect is that they get lost in the purse just as do other objects in the purse, and it may take a minute to find the flashlight so that it can be turned on and the search for the object wanted commenced. Applicant thought that it would be good to have a small light which could be seen in the purse or seen in the dark so that little or no time was lost in locating it. The flashlight disclosed hereinafter attains this end. It is true that it is most effective when the eyes are fully dilated, and hence it is not too helpful in an open purse exposed to sunlight. But the two bands, which are substantially white, at opposite ends of the flashlight are distinctive.

On a nightstand, the flashlight can be seen all night.

In designing the light, the applicant wished to take advantage of the regenerative properties of this phosphorescent material, which is obtainable on the market, and a feature of the invention is the provision of a regenerative or reactivation chamber immediately behind the flashlight reflector with means for introducing a portion of the light when the bulb is energized to regenerate the phosphorescent material. This is accomplished by placing the bottom of the bulb slightly below the plane of the reflector and utilizing a bulb having wire terminals with a glass base.

Another important object of the invention is to provide the flashlight with a universal mounting so that it can be permanently placed adjacent something that one wishes to see. Applicant attaches a pressure-sensitive adhesive. By removing its protective strip, the flashlight may be mounted above a light switch or keyhole. It may be mounted on an automobile steering wheel in such a way that the driver can hold on to the wheel with his right hand, using his thumb to press the wall of the flashlight and raise his left hand so that his wristwatch can be quickly read. It can be placed on a telephone receiver so that the receiver may be held and the thumb placed on the light and pressed so that the user can read the dial.

Another major feature of the invention is utilization of a case having at least one elastic wall and a switch actuateable by pressing the wall of the case.

Another feature is the use of a sleeve to carry the phosphorescent material, which sleeve is rolled from flat material. The phosphorescent material is difficult to apply uniformly unless it lies flat. The first embodiment of this invention shows the inside of the transparent or translucent case lined with phosphorescent material. It is extremely difficult to keep it uniform, whereas the second embodiment shows a split sleeve which was a sleeve of paper, etc., which was flat when the phosphorescent material was applied and remained flat until the phosphorescent material had dried. Or the phosphorescent material may be placed on the outside of the case, where unless protected it will wear off. Or the phosphorescent material may be placed in the material of the case wall itself where it will provide the primary object of htis invention. Doing this, however, results in a non-elastic case wall, and the switch mentioned above cannot be taken advantage of.

There are other features in the design, particularly the switch, and it is positioned on the side of the case opposite to the universal mounting.

THE DRAWINGS

Referring to the drawings.

Figures 1, 2, 3, 4, 5, 6, 7, 8, 9:
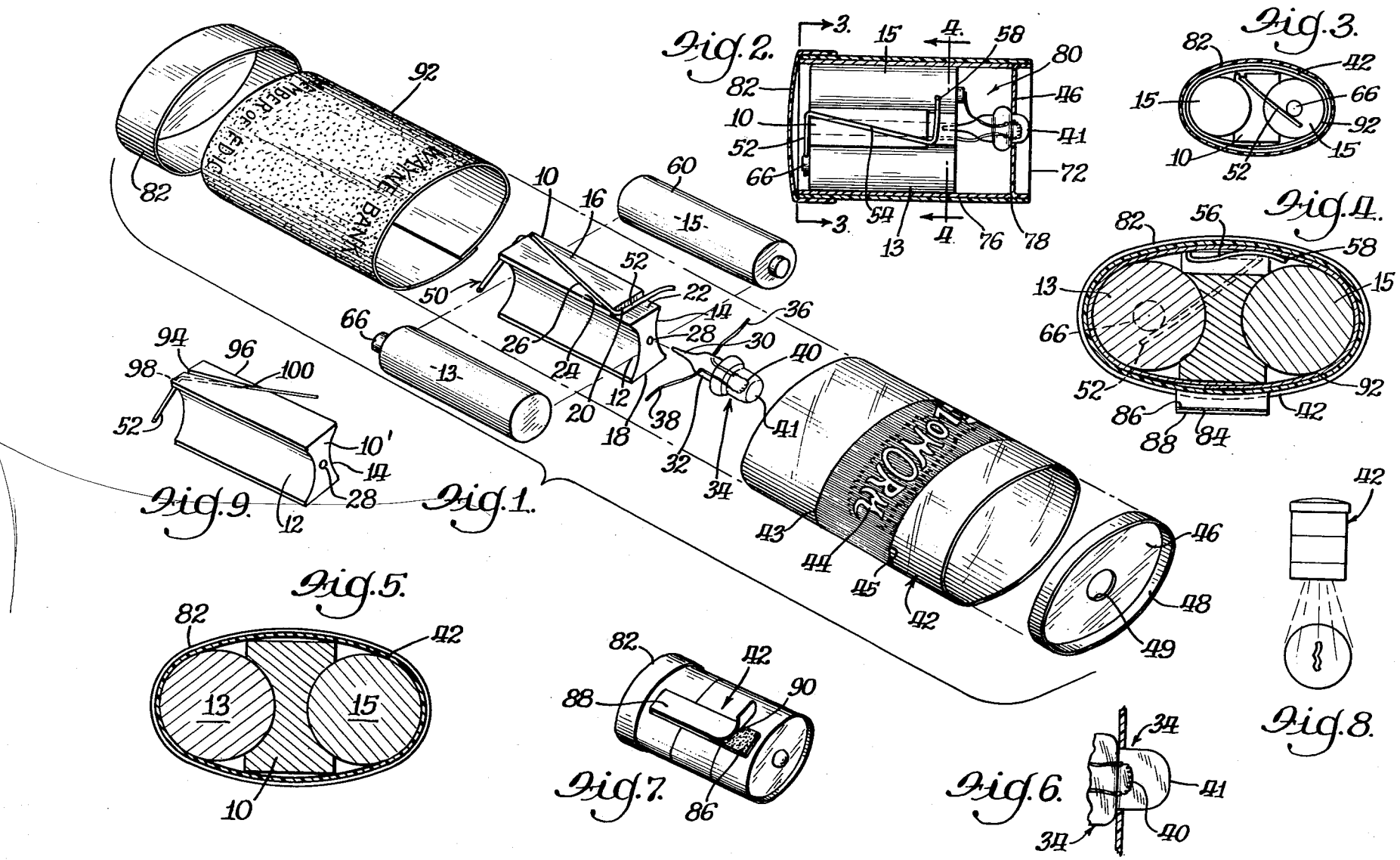
FIG. 1 is an exploded view of both embodiments of the flashlight preparatory to assembly.
FIG. 2 is a longitudinal section on the long cross axis of an assembled first embodiment of the invention.
FIG. 3 is a section taken on the line 3—3 of FIG. 2.
FIG. 4 is a section taken on the line 4—4 of FIG. 2.
FIG. 5 is a transverse section of the second embodiment of the invention without the sleeve.
FIG. 6 is an enlarged sectional view of the light bulg showing the ideal position of the filament of the bulb with respect to the reflecting surface.
FIG. 7 is a perspective view of the side of the case opposite to the switch side and showing the mounting strip with the protective sheet partially removed.
FIG. 8 shows the front side of a flashlight positioned over a keyhole.
FIG. 9 is a perspective view of a modified core and switch wire.

Referring to FIG. 1, 10 is a core of any suitable, electrically non-conductive material. It has two oppositely outwardly directed, circular, concave channels 12 and 14 of a radius adapted to seat batteries 13 and 15, and upper and lower flat surfaces 16 and 18 lying in parallel planes. In the upper surface 16 is a transverse slot 20, dividing the surface 16 into two lands 22 and 24. Land 24 contains, longitudinally of its surface, a diagonal slot 26. The core contains a socket or seat 28 at the midpoint of one end. Into this seats the tip 30 of the glass base 32 of a bulb 34. The bulb 34 has leads 36 and 38 and a filament 40. The bulb has a lenz tip 41.

The case of the flashlight is numbered 42. It is transparent or translucent, and its wall is quite flexible. Printed on the exterior of the case is a band including the word "Gloworm", 44, but in reverse. The strip between the lines 43 and 45 is opaque or dark in color but for the word "Gloworm." The outer end of the case is closed by a seal 46 having a peripheral rim 48 and a central hole 49. This seal is a plastic plate with a light-reflective white surface. The over-all length of the case is as little as one and one-half inches. The seal is recessed about one-eighth of an inch.

The inside of the case 42 is coated with a phosphorescent material. This material contains no phosphorus, and is not dangerous to workers. Its light-emitting retention varies from one to ten hours. It is regenerated by exposure to visible light for less than ten seconds. This material may be placed on the outside of the case and if the case is transparent, the first feature will be present, —a phosphorescent band that is regenerated each time the flashlight is activated.

The switch wire 50 is pressed into the slot 26 and the left end 52 is bent at right angles to the base portion 54, and the switch point 56 is bent as shown in FIGS. 2 and 4. The clearance between the tip 58 is a small fraction of an inch. The top of the wire 56 which is electrically conductive and elastic, engages the inside top of the case. A slight pressure on the outside of the case will contact the tip 58 with the can or wall 60 of the dry cell battery 15. This slight pressure is important where the flashlight is mounted on, sic, a wall. The user can see the flashlight, as explained later, but he must be able to flash it without too much pressure.

The batteries 62 and 64 are seated in the arcuate channels 12 and 14. The end 52 of the switch wire 54 is welded or otherwise attached to the positive terminal post 66 on its underside, —see FIG. 4. This is important because pressing the switch at 60, see FIG. 4, causes the torque on the wire to press the wire against the post 66 so that there is no pressure to break the connection between the wire and the post 66. If the wire is welded (or soldered) to the top side of the post 66, pressure on the tip 58 of the switch 50, see FIG. 4, tends to separate the leg 52 from the post 66, and after closing the switch many times, this may happen. The flashlight, which is a throw-away, is rendered useless.

The positioning of the switch arm 56 in the slot 20 is important because it is substantially impossible to close it by exerting great finger pressure, —the slot is too narrow for the thumb to penetrate. In earlier mode, the spring flexible means could be bent so that the tip 58 was left in permanent contact with the can 60, i.e., the light would not go out. In the disclosed construction, the force of the finger at 60 is unable to give a new set to the wire between the position 60 and 58 because the length of the wire between 60 and the battery post 66 is sufficient to resist deformation by a finger which cannot press the switch wire below the plane of the lands 22 and 24, —the actual deformation being taken up between 60 and 66. The width of the slot is only one-eighth of an inch.

The wire leads 36 and 38 of bulb 34 are respectively welded to terminal post 70 of battery 13 and can 15 of battery 64, see also FIG. 2. The batteries 13 and 15 are seated in the channels 12 and 14 of the core 10. The assembly is pushed into the case 42, —the bulb entering the hole 49 until its outer end is in the plane 72 of the outer end of the case 42. The position of the filament 40 with respect to the general plane of the seal 46 is important (in the commercial embodiment the seal is slightly convex).

As shown in FIG. 2, the space between the batteries and core on the one side and the bulb 34 and seal 46 on the other, which is the reflector, form with the case the phosphorescent regenerative chamber. The case 42 is transparent. In order to regenerate the phosphorescent material ech time the flashlight is actuated, the light of the bulb 34 must strike the wall band between the arrows 76 and 78, see FIG. 2. This could be done by positioning a separate bulb in the chamber with a second bulb to flash the light. Applicant however accomplishes the desired result, —external light and regenerative light, —by positioning the lamp bulb so that most of its filament is external to the reflector 46 but a small part of it is on the inside of the reflector 46, —that is, inside the phosphorescent chamber. The filament gives a small percentage of its light to the phosphorescent chamber 80 and its phosphorescent band, but most of its light to the outside, including the white reflective surface of the seal 46. The above-described relationship is ideal. In practice, the flashlight works almost as well if the filament is entirely on the outside of the seal 46 or entirely on the inside. This seems to be due to the glass stem of the bulb conducting some light from the filament into the regenerative chamber.

The flashlight is completed by pressing the cap 82 over the open end of the case 42 and fastening either by an adhesive or by melding with heat edges of the cap to the case. The flashlight as described, embodiment 1, is shown in cross section in FIG. 5.

The flashlight is a throw-away. If used as intended, i.e., to flash on a clock or keyhole, two or three second, it will last for the shelf life of the batteries, —one to two years.

Two features of the invention have been described. Another feature is a universal mounting on that side of the case opposite to the switch. Referring to FIGS. 4 and 7, the numeral 82 identifies a compliant strip of material such as rubber, one side of which is affixed to the case 42. The other side 84 carries a pressure-sensitive adhesive 86 covered by a protective strip of paper 88. The user may peel off the strip 88, as at 90 in FIG. 7, thereby exposing the pressure-sensitive adhesive. The flashlight may then be affixed to a wall above a keyhole or a switch, see FIG. 8, or on an automobile steering wheel, telephone receiver, inside wall of some lady's purse, etc.

The second embodiment of the invention is identical to the first embodiment excepting that a sleeve 92 is inserted over the completed flashlight chassis and then the whole chassis is inserted in the case, —see FIGS. 1, 2 and 5. The sleeve 92 is transparent or translucent, but coated on the outside with the phosphorescent material. The light chamber functions as in the first embodiment. The sleeve is of value on orders of less than 50,000, the minimum order for the cases 42 carrying the printing. The printing is done on large sheets and these sheets are easily coated with the phosphorescent material. The individual sleeves are then cut out and rolled so that two opposite edges abut each other, —as shown in FIG. 1. With a slight increase in cost to the purchaser, orders for as few of 100 are profitable.

In FIG. 9, applicant shows an alternative core and switch. The core 10' is identical with the core 10 but there is just one slot in it. The slot extends from the midpoint 94 of diagonally toward the wall 96. Its depth varies from the end 94 from about twice the thickness of the wire at 98 to emerging at 100 in the top of the slot. The slope is such and the length of the wire is such that it engages the inside top of the sleeve 42. The only bend is the leg 52. It has been discovered that this construction is as free from abuse as is the construction shown in FIG. 1. Importantly, it is much easier to make, there being only one bend in it, and very easy to assembly.

The reactivatable phosphorescent material is a zinc sulphide or zinc-cadmium sulphide, and they are chemically stable insoluble materials. The phosphorescent afterglow lasts from 30 minutes to 10–12 hours or more, depending on the pigment. They are available in the United States on the open market.

Having thus described my invention, I claim:

1. An electrical flashlight comprising a flashlight case having a resilient contact portion of electrically insulating material, at least first and second electrically coupled batteries carried within said case, each of said batteries having an electrically conducting can acting as one terminal thereof and a terminal post acting as a second terminal of opposite polarity electrically isolated from said can, an externally directed electrically energizable flashlight bulb carried by said case and having a pair of electrical terminals, each one of said terminals being mutually exclusively electrically coupled to a terminal of opposite polarity of each of said batteries, and a resilient electrically conducting cantilevered switch wire having one end electrically coupled to and supported from one terminal of one of said batteries and an opposite free end extending to a position normally adjacent to and spaced from a terminal of opposite polarity of the other of said batteries, said switch wire being carried within said case adjacent to said resilient electrically insulating contact portion such that said switch wire is closed into electrical contact with said adjacent normally spaced battery terminal to illuminate said flashlight bulb upon flexing said resilient contact portion of said flashlight case.

2. The apparatus of claim 1 wherein one end of said resilient electrically conducting cantilevered switch wire is secured to the terminal post of said first electrically coupled battery and the free end thereof extends to a position adjacent to but spaced from the electrically conducting can of said second electrically coupled battery such that upon flexual movement of said resilient electrically insulative contact portion of said flashlight case an electrical circuit will be completed for illuminating said flashlight bulb.

3. The apparatus of claim 2 wherein the electrical terminals of said flashlight bulb comprise first and second flexible electrically conductive leads, said first electrically conductive lead being secured to the can of said first electrically coupled battery, and said second electrically conductive lead being secured to the terminal post of said second electrically coupled battery.

4. The apparatus of claim 1 wherein said flashlight case comprises a resilient electrically insulating material.

5. The apparatus of claim 2 wherein securing connections are welds.

* * * * *

UNITED STATES PATENT AND TRADEMARK OFFICE

CERTIFICATE OF CORRECTION

PATENT NO. : 4,210,953

DATED : July 1, 1980

INVENTOR(S) : Wilfred S. Stone

It is certified that error appears in the above—identified patent and that said Letters Patent is hereby corrected as shown below:

Column 3, line 19, "mode" should read -- models --.

Column 3, line 47, "ech" should read -- each --.

Signed and Sealed this

*Twenty-first* Day of *October 1980*

[SEAL]

*Attest:*

SIDNEY A. DIAMOND

*Attesting Officer*

*Commissioner of Patents and Trademarks*